US007143843B2

(12) United States Patent
Doering et al.

(10) Patent No.: US 7,143,843 B2
(45) Date of Patent: Dec. 5, 2006

(54) TRACTION CONTROL FOR DOWNHOLE TRACTOR

(75) Inventors: Falk W. Doering, Houston, TX (US); Todor K. Sheiretov, Houston, TX (US); Robin A. Ewan, Stafford, TX (US); Benoit A. Foubert, Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 214 days.

(21) Appl. No.: 10/751,599

(22) Filed: Jan. 5, 2004

(65) Prior Publication Data

US 2005/0145415 A1 Jul. 7, 2005

(51) Int. Cl.
*E21B 4/18* (2006.01)
*E21B 19/08* (2006.01)
*E21B 44/00* (2006.01)

(52) U.S. Cl. ..... 175/24; 175/61; 175/94; 175/99

(58) Field of Classification Search ..... 175/24, 175/94, 26, 27, 61, 99; 166/250.01
See application file for complete search history.

(56) References Cited

U.S. PATENT DOCUMENTS

| | | | | |
|---|---|---|---|---|
| 5,184,676 | A | 2/1993 | Graham et al. | |
| 5,375,668 | A * | 12/1994 | Hallundbaek | 175/53 |
| 5,649,603 | A | 7/1997 | Simpson et al. | |
| 5,960,895 | A | 10/1999 | Chevallier et al. | |
| 6,031,371 | A * | 2/2000 | Smart | 324/220 |
| 6,089,323 | A | 7/2000 | Newman et al. | |
| 6,179,055 | B1 | 1/2001 | Sallwasser et al. | |
| 6,387,009 | B1 | 5/2002 | Haka | |
| 6,445,337 | B1 | 9/2002 | Reiche | |

FOREIGN PATENT DOCUMENTS

DE 197 18 515 A1 3/1998

* cited by examiner

*Primary Examiner*—Kenneth Thompson
(74) *Attorney, Agent, or Firm*—Rodney Warfford; Tim Curington; Bill Batzer

(57) ABSTRACT

Apparatus, system and methods useful for controlling the traction of a downhole tractor in a borehole include the capability of repeatedly adjusting the normal force applied to at least one component that causes movement of the tractor in the borehole.

18 Claims, 13 Drawing Sheets

TRACTION CONTROL FOR DOWNHOLE TRACTOR

BACKGROUND OF THE INVENTION

The invention relates to apparatus, systems and methods for controlling or adjusting the traction of a downhole tractor in a borehole.

In the petroleum exploration and production industries, downhole tractors are often used to convey tools and other devices into boreholes. However, downhole tractors may be used for any desired purpose. As used throughout this patent, the terms "tractor", "downhole tractor" and variations thereof means a powered device of any form, configuration and components capable of crawling or moving within a borehole. The term "borehole" and variations thereof means and includes any underground hole, passageway or area. An "open borehole" is a borehole that does not have a casing. A "non-vertical borehole" is a borehole that is at least partially not vertically oriented, such as a horizontal or deviated well.

Typically, the movement of the tractor is enabled by friction-generated traction between one or more component associated with the tractor, referred to herein as the "drive unit(s)," and the borehole wall. In such instances, a normal force is usually applied to the drive unit to press it against the borehole wall.

For a tractor to achieve or maintain movement within a borehole, the drive unit cannot completely slip relative to the borehole wall, so that the traction force $(F_T) \leqq \mu F_N$, where $\mu$ is the friction coefficient between the drive unit and the borehole wall and $F_N$ is the normal force. Also, the drive unit must provide enough traction force to overcome drag or resistance $(F_R)$ on the drive unit, such as may be caused by the conveyed tool(s) and delivery cable, so that $F_T \geqq F_R$.

Any number of other factors (referred to throughout this patent as "disturbance factors") may affect the amount of traction necessary to move the tractor within the borehole in any particular situation and environment of operation. For example, when the borehole wall possesses an irregular surface, the amount of traction necessary for movement and/or the coefficient of friction may change as the borehole surface navigated by the tractor changes. A few other examples of disturbance factors that may affect the tractor's resistance to motion are changes in the inclination of the borehole, diameter of the borehole, surface of the borehole, borehole wall properties, increasing cable drag (when a cable is used), debris in the borehole and borehole fluid properties.

When the amount of traction needed for the tractor to move or continue moving in the borehole changes, the normal force on the drive unit(s) must be adjusted. Otherwise, the tractor may experience excessive slippage. Hence, in order to keep $F_T \leqq \mu F_N$, the normal force $F_N$ has to be adjusted. The normal force may also need to be adjusted when it is desired to prevent power overload or unnecessary excessive normal force. Thus, although not essential for tractor operations (or the present invention), an ideal value for the normal force is $F_N = F_T/\mu$, particularly when the tractor is moving in an open, non-vertical or highly deviated borehole.

If the borehole conditions change infrequently and there are no substantial tractor disturbance factors, such as may exist in a "cased" borehole, the normal force may be effectively adjusted by an operator sending commands to the tractor from the surface using existing technology. However, when the amount of needed traction changes often, such as in an open borehole or because of the existence of disturbance factors, the operator is unlikely to react sufficiently, often or quickly enough, resulting in excessive slippage and, thus, poor tractor performance, and/or excessive power to the drive units. Examples of existing downhole tractor technology not believed to provide sufficient or efficient traction control in such instances are disclosed in U.S. Pat. No. 6,089,323 issued on Jul. 18, 2000 to Newman et al. and U.S. Pat. No. 5,184,676 issued on Feb. 9, 1993 to Graham et al. Examples of existing traction control technology for entirely different applications not involving downhole tractors are U.S. Pat. No. 6,387,009B1 to Haka and issued on May 14, 2002 and German Patent DE 19,718,515 to Bellgardt and issued on Mar. 26, 1998. Each of the above-referenced patents is hereby incorporated by reference herein in its entirety.

Thus, there remains a need for methods, apparatus and/or systems that are useful with downhole tractors and have one or more of the following attributes, capabilities or features: adjusting the normal force on one or more drive unit continuously, automatically, without human intervention, on a real-time basis, or any combination thereof; optimizing the traction of the drive unit(s) in the borehole by adjusting or controlling the normal force; applying as much normal force as necessary to reduce slippage and as little normal force as necessary to minimize waste of available power; adjusting the normal force as quickly as possible without the necessity of human involvement; reacting to or dealing with typical disturbance factors by adjusting the normal force on the drive unit(s); real-time adjustment of normal forces on the drive unit(s) to maintain or cause movement of the tractor in the borehole; allowing the tractor to achieve continuous motion, as may be desired or required in downhole data logging applications, at the lowest effective normal force; preventing excessive or unnecessary wear on components, loss of energy and casing or formation damage caused by excessive normal forces.

BRIEF SUMMARY OF THE INVENTION

Various embodiments of the invention involve a method of controlling the traction of a downhole tractor in a borehole, the traction created by applying normal force to at least one drive unit associated with the tractor, the method including repeatedly determining the slip of the at least one drive unit, repeatedly determining if the slip is excessive, and if the slip is excessive, increasing the normal force on the at least one drive unit.

In other embodiments, instead of increasing the normal force when slip is excessive, the normal force on the at least one drive unit is decreased if the slip is below a minimum acceptable level. In yet other embodiments, both the increasing and decreasing options are included.

Some embodiments of the present invention include a method of adjusting the traction of a downhole tractor in a borehole, the method including measuring the velocity of drive unit(s), measuring the velocity of the tractor, determining the slip of the drive unit(s) based upon the velocity of the drive unit(s) and the velocity of the tractor and comparing the slip of the drive unit(s) to an acceptable slip value or range to determine if the slip of the drive unit(s) is excessive. If the slip of the drive unit(s) is excessive, the normal force on the drive unit(s) is increased.

In many embodiments of the present invention, a method of real-time, dynamic adjustment of the traction of a downhole tractor in a borehole without human intervention includes increasing the normal force on at least one drive unit when the slip of the drive unit(s) relative to the borehole wall is excessive and decreasing the normal force on the drive unit(s) when the slip is below a minimum acceptable level.

There are embodiments of the invention that involve a method of real-time, dynamic adjustment of the traction of a downhole tractor in a borehole without human intervention, the method including changing the normal force applied to at least one drive unit in response to a suitable change in at least one among the diameter of the borehole, the presence of debris in the borehole, one or more borehole fluid property, the surface of the borehole, the inclination of the borehole, one or more borehole wall property, the actual slip of the at least one drive unit relative to the borehole wall, the coefficient of friction between the at least one drive unit and the borehole wall, and the drag created by a cable connected with the tractor.

The present invention may be embodied in a method of optimizing the amount of energy required for maintaining the movement of a downhole tractor within a borehole without human intervention, the method including automatically, dynamically adjusting the normal force applied to at least one drive unit in response to changes in the actual slip of the at least one drive unit relative to the borehole wall as compared to an acceptable slip value or range.

Yet various embodiments involve a method of optimizing the amount of energy required for maintaining the movement of a downhole tractor within a borehole, the method including automatically changing the normal force applied to at least one drive unit without human intervention in response to one or more change in at least one among the diameter of the borehole, the presence of debris in the borehole, one or more borehole fluid property, the surface of the borehole, the inclination of the borehole, one or more borehole wall property, the actual slip of the drive unit relative to the borehole wall, the coefficient of friction between the drive unit and the borehole wall, and the drag created by a cable connected with the tractor.

Various embodiments of the invention involve an apparatus for adjusting the traction of a downhole tractor that is moveable within a borehole and which includes at least one drive module. The drive module includes at least one drive unit that is engageable with and moveable relative to a wall of the borehole. At least one measuring unit is capable of determining the velocity of the tractor in the borehole. Each drive module is capable of determining the velocity of at least one drive unit in the borehole and applying normal force to such drive unit(s) to cause it to engage and move with respect to the borehole wall. Each drive module is also capable of varying the normal force on the at least one drive unit based upon the velocity of the tractor and the velocity of the drive unit.

Some embodiments involve a drive module useful for controlling the traction of a downhole tractor in a borehole. The drive module includes: at least one drive unit engageable with and moveable relative to a wall of the borehole to move the tractor through the borehole; at least one normal force generator capable of applying a normal force to at least one drive unit to cause the drive unit to move relative to the borehole; and at least one normal force controller in communication with the at least one normal force generator and capable of causing the normal force generator to vary the magnitude of the normal force applied to at least one drive unit based upon the slip of the drive unit.

The present invention may be embodied in a system useful for adjusting the traction of a downhole tractor in a borehole that includes at least two drive modules capable of generating and applying a normal force and moving the tractor through the borehole. At least one measuring unit is capable of repeatedly determining at least one among the velocity of the tractor in the borehole and the diameter of the borehole. A main controller is in communication with the drive modules and the measuring unit. Each drive module is capable of varying the magnitude of normal force required for moving the tractor through the borehole based at least partially upon signals received from the main controller.

Accordingly, the present invention includes features and advantages which are believed to enable it to advance downhole tractor technology. Characteristics and advantages of the present invention described above and additional features and benefits will be readily apparent to those skilled in the art upon consideration of the following detailed description of preferred embodiments and referring to the accompanying drawings.

BRIEF DESCRIPTION OF THE DRAWINGS

For a detailed description of preferred embodiments of the invention, reference will now be made to the accompanying drawings wherein.

DETAILED DESCRIPTION OF PREFERRED EMBODIMENTS OF THE INVENTION

Figure 1:
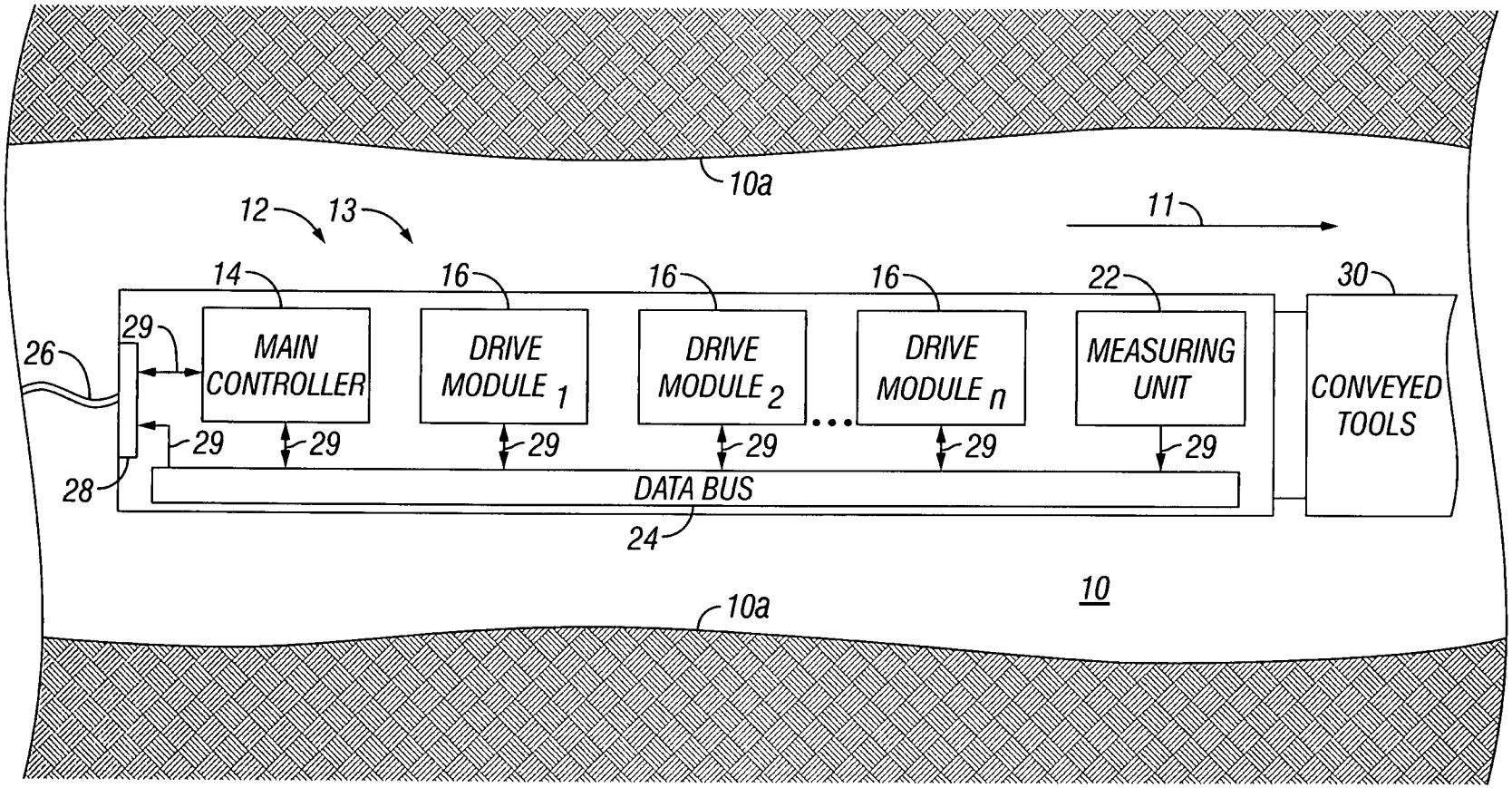
FIG. 1 is partial block diagram of a downhole tractor equipped with an embodiment of a traction control system in accordance with the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents, and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof are not intended to mean the claimed invention of any particular appended claim or claims, or all of the appended claims. The subject or topic of each such reference is thus not necessarily part of, or required by, any particular claim(s) merely because of such reference.

Referring initially to FIG. 1, an embodiment of a downhole tractor 12 equipped with an exemplary traction control system 13 of the present invention is shown in partial block diagram format deployed in a borehole 10. The illustrated tractor 12 includes a main controller 14, multiple drive modules 16 and a measuring unit 22. The drive modules 16 each include at least one drive unit (not shown) and displace, or move, the tractor 12 and any attached devices, such as one or more conveyed tool 30, through the borehole 10. The conveyed tools 30 are shown located forward of the tractor 12 and traction control system 13 with respect to the direction of movement 11 of the tractor 12 in the borehole 10. However, the conveyed tools 30 or other devices may be located rearward of or adjacent to the tractor 12, or sandwiched between different components of the tractor 12 and/or traction control system 13, or a combination thereof. Moreover, the inclusion of conveyed tools or other devices is not required.

Still referring to FIG. 1, the measuring unit 22 of this embodiment determines the speed of the tractor 12 in the borehole 10. If desired, the measuring unit 22 may instead or also measure other information, such as the diameter (D) of the borehole 10, rugosity, etc. Data and commands may be exchanged between the main controller 14 and the drive modules 16 and measuring unit 22 via a data bus 24. The main controller 14 may communicate with the surface (not shown) and vise versa through a cable 26 and user interface 28. For example, data or commands (e.g., requested initial tractor speed) may be sent from an operator or device at the surface to the main controller 14, and information (e.g., the number of active drive units) may be sent from the main controller 14 to the surface. Various data flow paths of this embodiment are generally indicated with arrows 29.

The main controller 14, drive modules 16, measuring unit 22 and other exemplary components may be of any desired type and configuration. Moreover, the particular components and configuration of FIG. 1 are neither required for, nor limiting upon, the present invention. For example, while three drive modules 16 and one measuring unit 22 are shown, the tractor 12 may include any quantity of drive modules and measuring units. For another example, the main controller 14 and measuring unit 22, while shown located within the tractor 12, may instead be located at the surface 12 or within the cable 26 or another component. Further, any among the main controller 14, drive module(s) 16, measuring unit 22, data bus 24, cable 26 and cable interface 28 may not be distinct components, but instead their functionality performed by, incorporated or integrated into, one or more other part or component. The "drive module", for example, may not be a distinct module, but may be any configuration of components capable of generating and applying the normal force to a component to move the tractor in the borehole.

Figure 2:
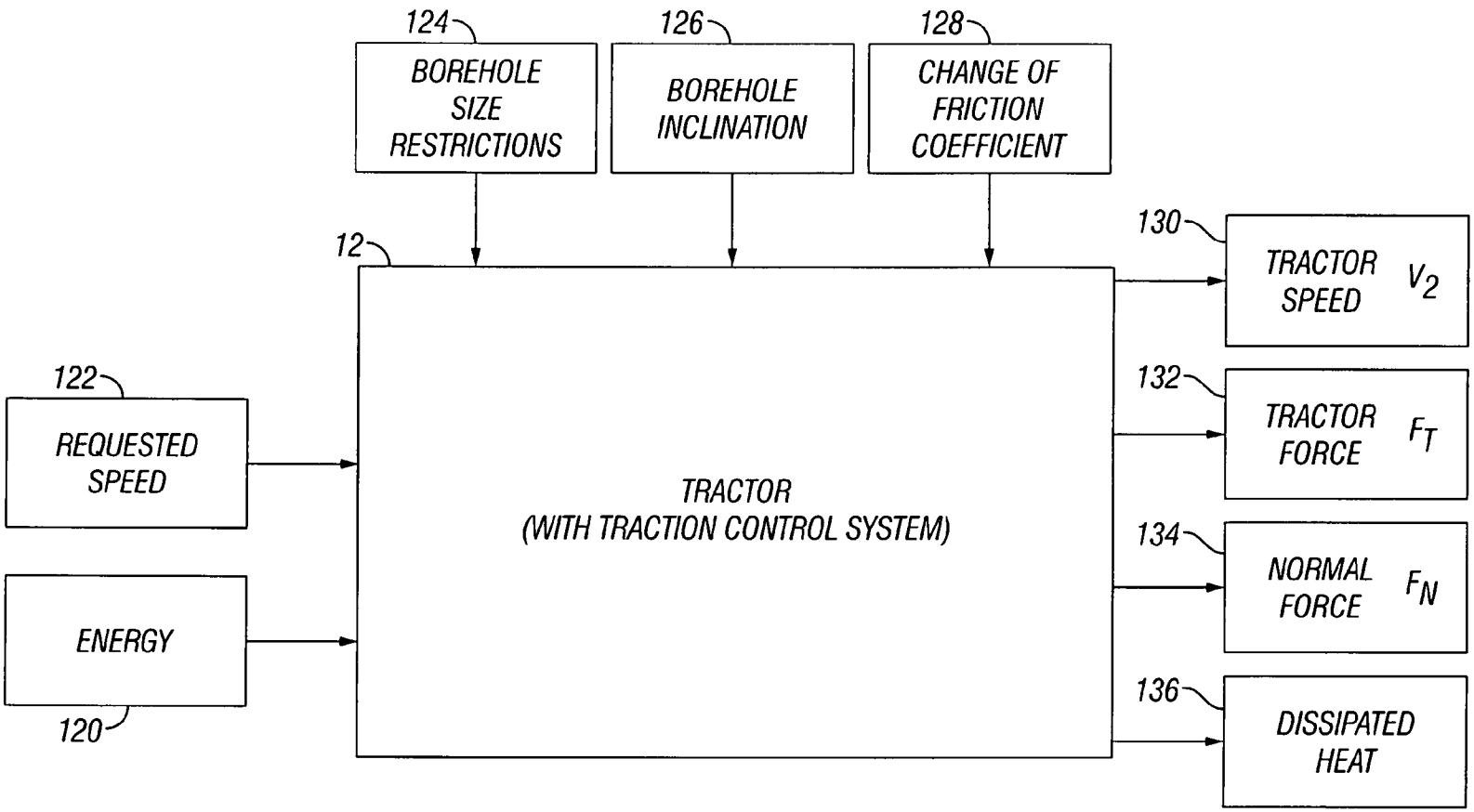
FIG. 2 is a block diagram showing various example inputs, outputs and disturbance factors of the exemplary tractor of FIG. 1.

Now referring to FIG. 2, the tractor 12 of the embodiment of FIG. 1 has various inputs, outputs and disturbance factors. Example inputs include energy 120 and requested tractor speed settings 122. The energy may be electric or hydraulic power or any other desired, suitable form of energy capable of sufficiently powering the tractor and/or traction control system. Some example potential outputs include tractor velocity 130, traction force 132, normal force applied to the drive unit(s) 134 and dissipated heat 136. Some example disturbance factors that may act upon the tractor 12 in the borehole, influence its traction and thus hinder its ability to move effectively through the borehole are borehole size restrictions 124, borehole inclination 126 and changes in the coefficient of friction 128. However, these particular inputs, outputs and disturbance factors are neither required by, nor limiting upon, the present invention.

In accordance with the present invention, the normal force on the drive unit(s) is adjusted, if necessary, as the tractor moves through the borehole to establish or maintain traction, or to achieve or maintain a particular tractor velocity. In accordance with one embodiment of the invention, referring to the flow diagram of FIG. 3, when the downhole tractor (not shown) is deployed in the borehole, a value for the actual slip $S_A$ of the drive unit(s) is obtained (step 140). The actual slip $S_A$ may be detected or determined in any desirable manner. In some embodiments, for example, the actual velocity $V_1$ of the drive unit(s) and the actual velocity $V_2$ of the tractor are determined, and the slip $S_A$ calculated based upon the formula $S_A=(V_1-V_2)/V_1$. For another example, the actual slip $S_A$ may be detected based upon the formula $S_A=V_1-V_2$.

Figure 3:
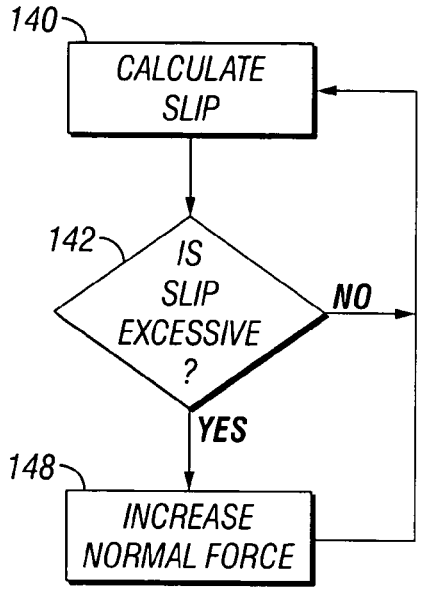
FIG. 3 is a flow diagram illustrating the process of an embodiment of a method of adjusting traction in accordance with the present invention.

Still referring to the embodiment of FIG. 3, the slip value for the drive unit(s) of this example is then evaluated to determine if it is excessive (step 142). For example, the actual slip $S_A$ may be compared to an optimal, desired or acceptable value or range of slip $S_o$ (the "acceptable slip"). The acceptable slip $S_o$ may be provided, or detected in any desirable manner. For example, in one embodiment, the acceptable slip will occur when the derivative of $\eta$ with respect to s $(d_\eta/d_s)=0$, where $\eta=(\text{Force})(V_2)/\text{Input Power}$. If the drive unit is electric, for example, "Force" and "Input Power" may be calculated based upon the torque or load cell, current and voltage of the respective drive unit. If the slip $S_A$ of a drive unit is excessive, the normal force $F_N$ on that drive unit(s) is increased (step 148). The above process is repeated on a continuing basis and the normal force $F_N$ applied to the drive unit(s) automatically increased each time excessive slip is found (so long as tractor movement in the borehole is desired). If desired, this methodology may be repeated on a "real-time" basis. As used herein and in the appended claims, the term "real-time" and variations thereof means actual real-time, nearly real-time or frequently. As used herein and in the appended claims, the term "automatic" and variations thereof means the capability of accomplishing the relevant task(s) without human involvement or intervention. The frequency of repetition of this process may be set, or varied, as is desired. For example, the frequency of repetition may be established or changed based upon the particular borehole conditions or type, or one or more disturbance factor.

Figure 4:
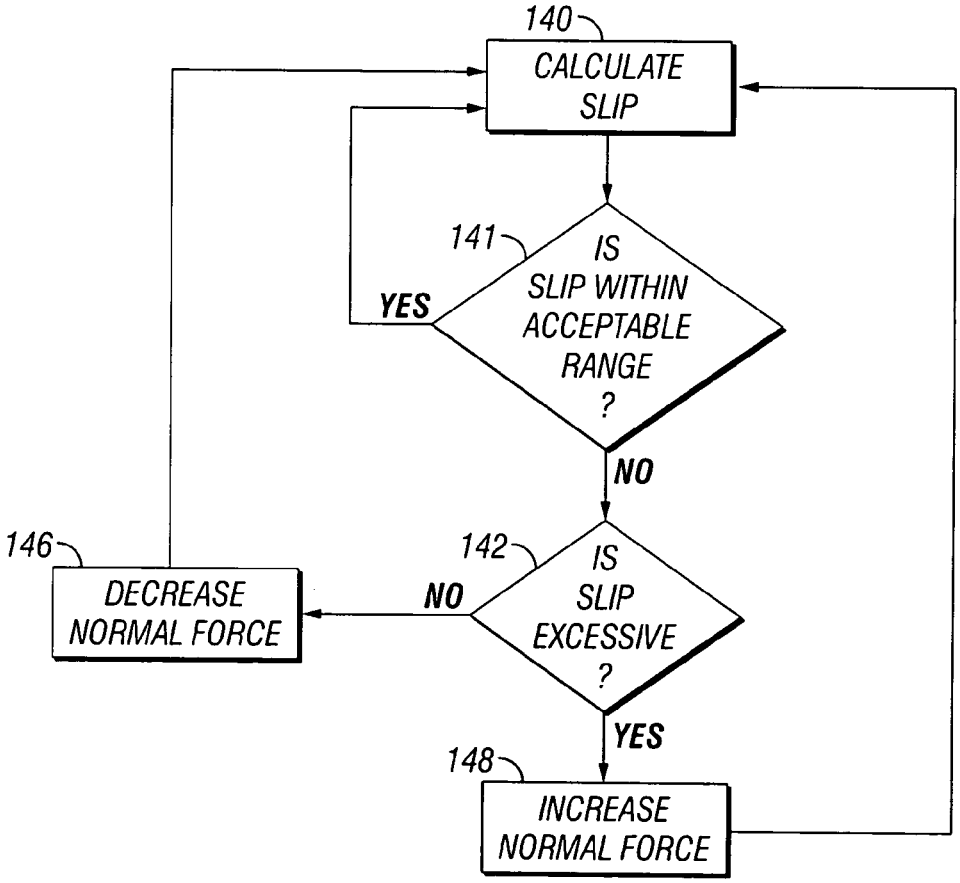
FIG. 4 is a flow diagram illustrating the process of another embodiment of a method of adjusting traction in accordance with the present invention.

In some embodiments, if desired, the normal force $F_N$ on the drive unit(s) may instead or also be adjusted in an effort to optimize energy usage, prevent excessive increases of the normal force(s), maintain a constant tractor velocity, or for any other desired reason. For example, in the embodiment diagramed in FIG. 4, the slip $S_A$ is determined and compared to an acceptable slip range (step 141). If the actual slip $S_A$ is within the acceptable slip range, the repeats continuously as desired. Whenever the Slip $S_A$ is outside the acceptable slip range, the Slip $S_A$ is compared to a maximum slip value (step 142). If the slip $S_A$ is above the maximum slip value (excessive slip), the normal force $F_N$ on that drive unit(s) is increased (step 148). If not (the slip $S_A$ is below the acceptable slip range), the normal force $F_N$ on that drive unit(s) is decreased (step 146). In the embodiment of FIG. 4, the normal force $F_N$ is thus dynamically, automatically adjusted to apply only as much normal force $F_N$ as is necessary. In other embodiments (not shown), there may be circumstances where it is desirable to optimize energy usage by decreasing the normal force when actual slip $S_A$ is below an acceptable slip value or range, but not to increase normal force when slip is excessive.

Any suitable control, communication, measuring and drive components and techniques may be used with any type of downhole tractor to perform the traction control methodology of the present invention.

Figure 5:
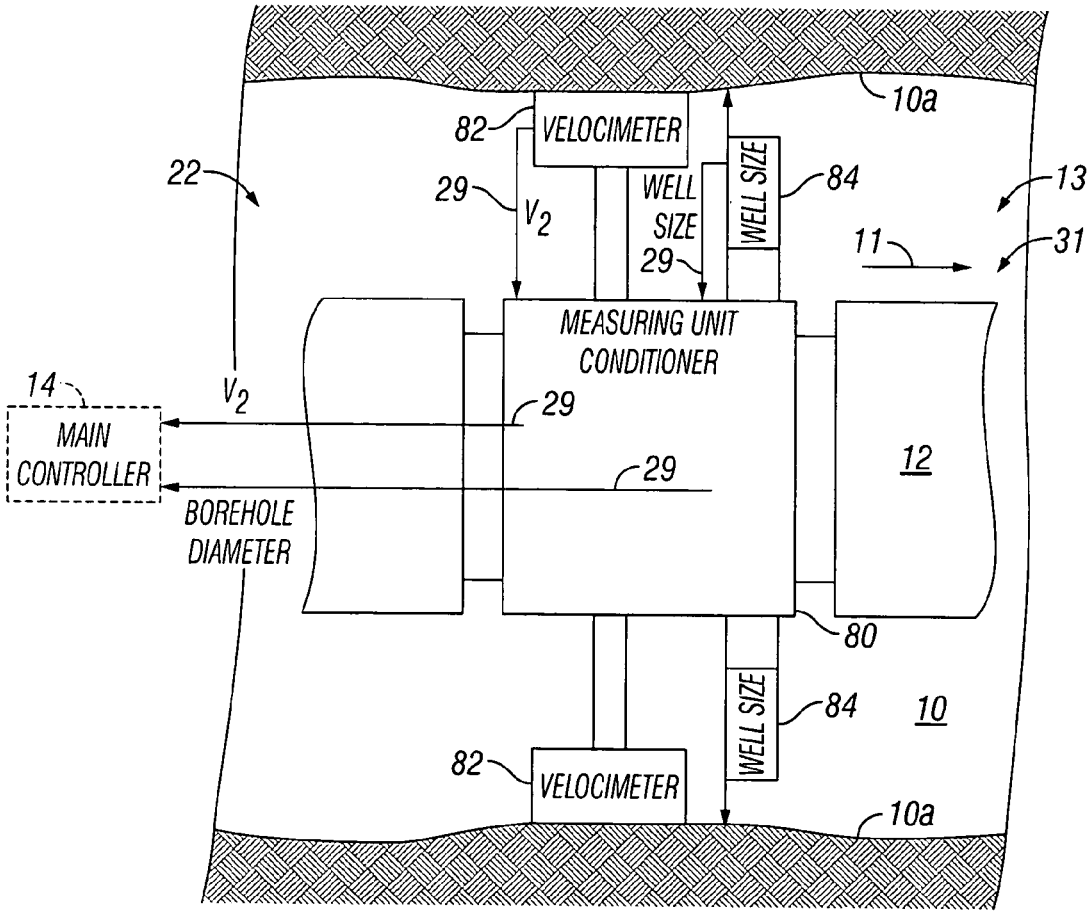
FIG. 5 is a generalized representation in partial block diagram of an embodiment of a tractor velocity measuring unit in accordance with the present invention deployed in a borehole.

FIG. 5 is a generalized representation of an embodiment of the measuring unit 22 in partial block diagram format disposed in a borehole 10. The measuring unit 22 may be positioned as is desired. For example, the measuring unit 22 may be aligned with the drive units (not shown), positioned lengthwise, included within or separate from the tractor 12 or a tool string 31, or a combination thereof. If the measuring unit 22 is located forward of the drive unit(s) 16 relative to the direction of movement 11 of the tractor 12 in the borehole 10 (see e.g. FIG. 1), information obtained by the measuring unit 22 such as, for example, borehole diameter, may be used in determining normal force adjustment in anticipation of the drive unit's upcoming borehole conditions. Further, multiple measuring units 22 may be desirable in various instances, such as for bi-directional tractoring.

Still referring to the "black box" representation of FIG. 5, the illustrated measuring unit 22 includes a pair of velocimeters 82 capable of measuring the velocity of the tractor 12. While two velocimeters 82 are shown, any number may be included. This embodiment also includes an optional well size detector 84 capable of measuring the diameter of the borehole 10. A measuring unit conditioner 80 is shown receiving and processing data from the velocimeters 82 (and well size detector 84) and communicating data to the main controller 14.

Figure 6:
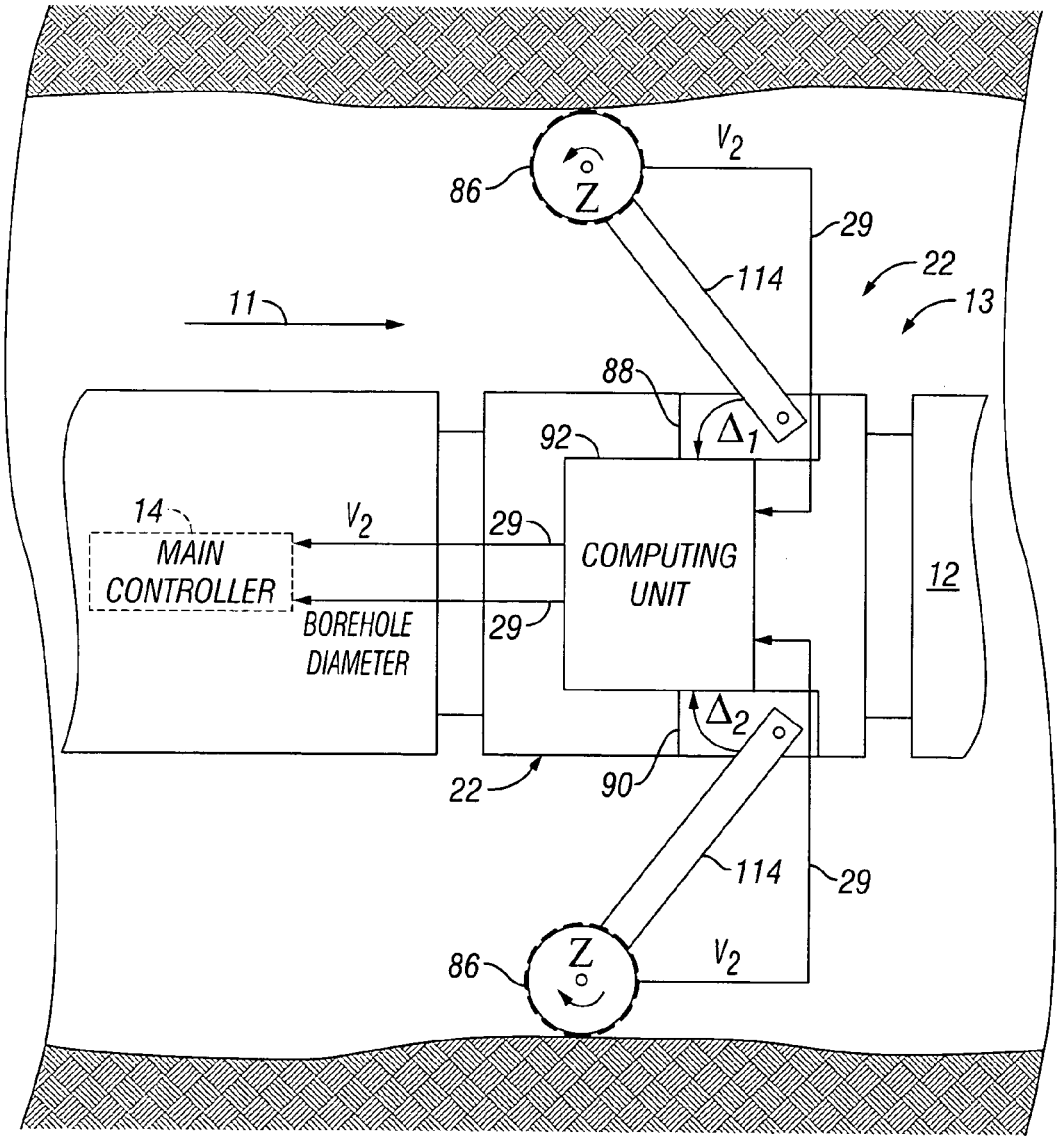
FIG. 6 is a partial block diagram of an embodiment of a measuring unit in accordance with the present invention deployed in a borehole.
Figure 7:
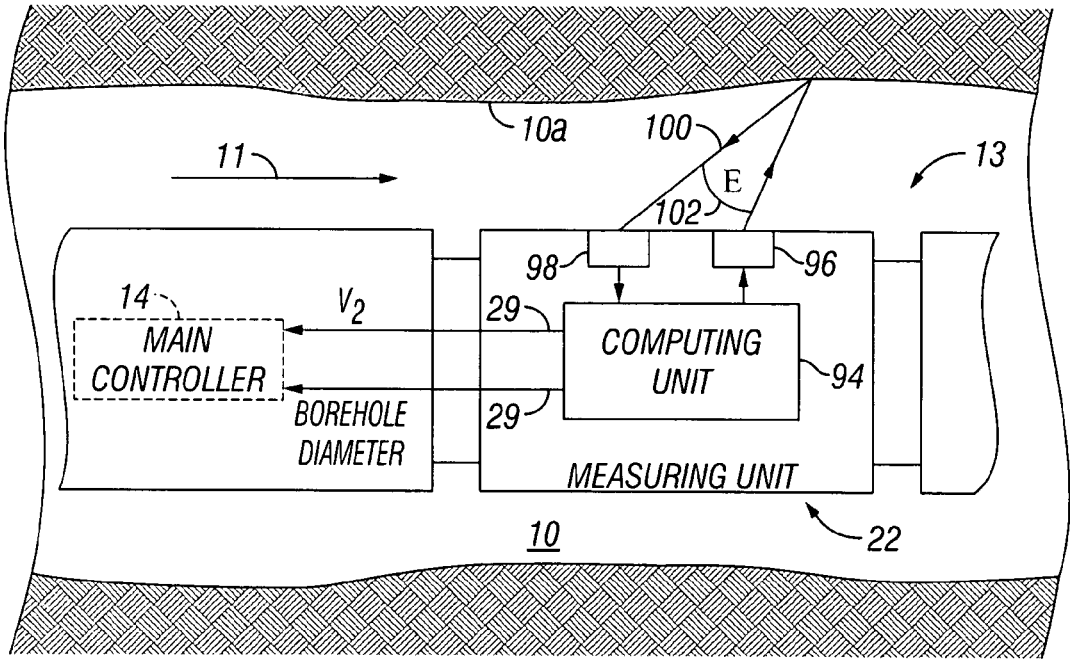
FIG. 7 is a partial block diagram of another embodiment of a measuring unit in accordance with the present invention deployed in a borehole.
Figure 8:
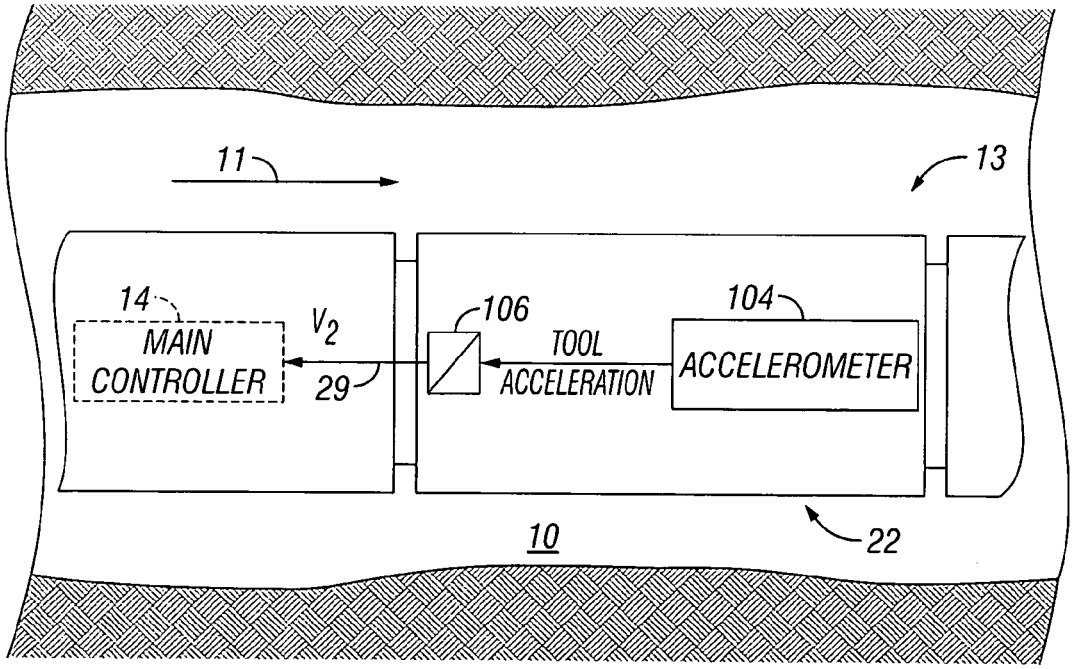
FIG. 8 is a partial block diagram of still another embodiment of a measuring unit in accordance with the present invention deployed in a borehole.

FIGS. 6–8 show some examples of particular types of measuring units 22 in partial block diagram format disposed in a borehole 10. In the embodiment of FIG. 6, the measuring unit 22 includes a pair of idlers 86, angle sensors 88, 90 and a computing unit 92. Such a dual system allows slippage correction and calculation of well diameter; however, any number of one or more idler 86 and angle sensor 88, 90 may be used. The idlers 86 of this example are mounted on spring biased idler rods 114 to bias them outwardly against the borehole wall 10*a* and prevent excessive slippage of the idlers 86. The angle sensors 88, 90 detect the angle between the tractor 12 and the rods 114, and the idlers 86 measure their own rotational speed in the borehole 10. The computing unit 92 calculates the actual tractor velocity and, if desired, the borehole diameter based upon the length of the rods 114 and the angles $\Delta_1$ and $\Delta_2$.

In the embodiment of FIG. 7, the tractor speed and, if desired, the borehole diameter are determined by using the Doppler effect. This embodiment includes a Doppler effect computing unit 94, a sending unit 96 and a receiving unit 98. The sending unit 96 sends beams 100 continuously at a certain frequency to the borehole wall 10*a*. The beams reflect back from the borehole wall 10*a* to the receiving unit 98 at a certain angle E 102. The beams 100 can be of any suitable type, such as, for example, electromagnetic or acoustic beams. The Doppler effect computing unit 94 computes the tractor speed based upon the frequency difference. If desired, the computing unit 94 may also compute the borehole diameter based upon the angle E 102. An example of the components and methodology that may be used to measure velocity based upon the Doppler effect are shown and described in U.S. Pat. No. 6,445,337 issued on Sep. 3, 2002 to Reiche, which is hereby incorporated by reference herein in its entirety.

FIG. 8 shows an embodiment of the measuring unit 22 that includes an accelerometer 104 and an integrator 106. The accelerometer 104 continuously measures the acceleration of the tractor 12, which information is integrated by the integrator 106 to determine tractor velocity.

Figure 9:
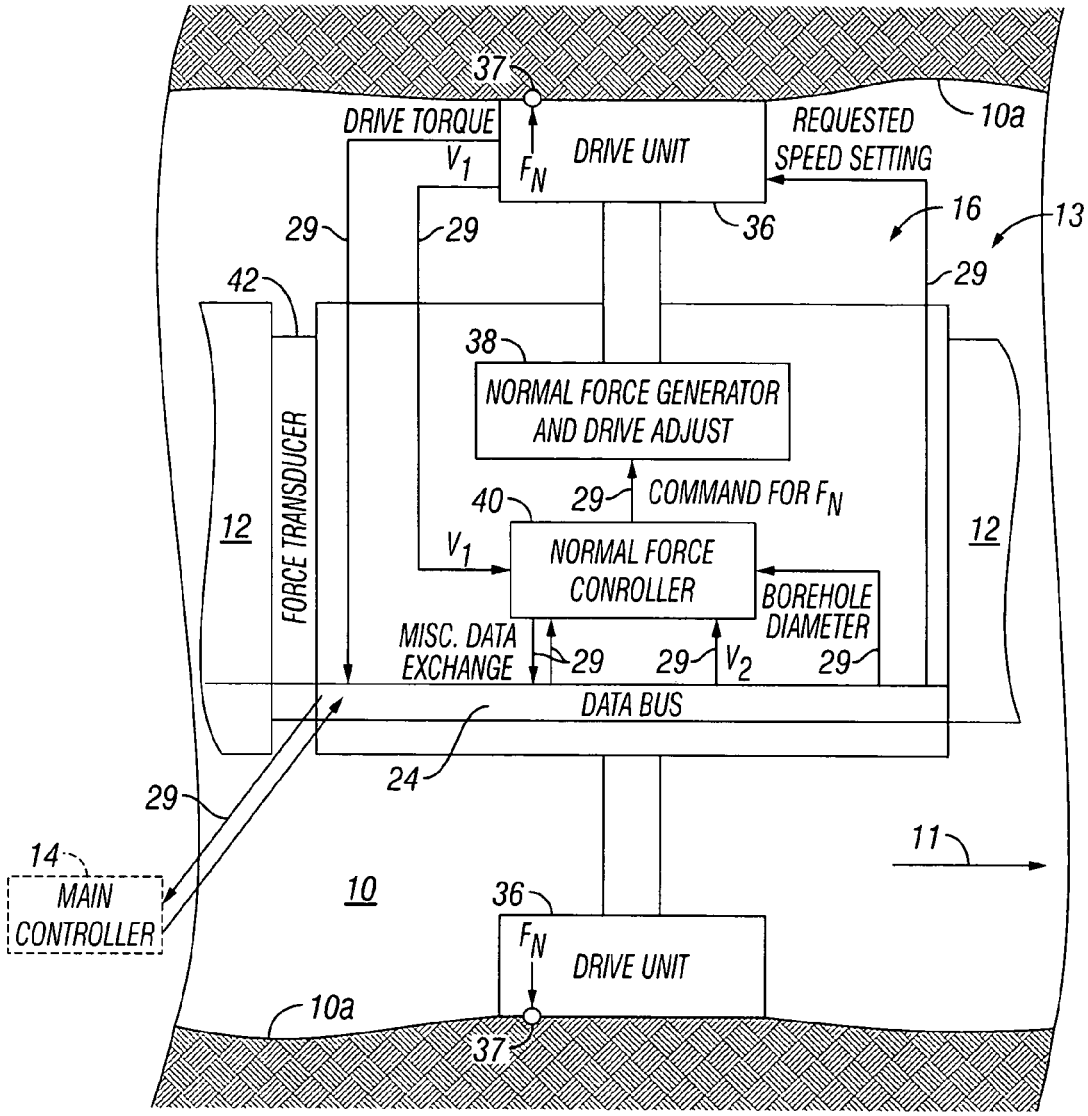
FIG. 9 is a generalized representation in partial block diagram of an embodiment of a drive module in accordance with the present invention deployed in a borehole.

Referring now to FIG. 9, a generalized representation of an embodiment of a drive module 16 is shown in partial block diagram format deployed in a borehole 10. The illustrated drive module 16 includes two drive units 36, each pressed by a normal force generator 38 against the borehole wall 10*a* at an interface 37. The normal force generator 38 may be any suitable device, such as an electrically, hydraulically, spring or mechanically actuated device. It should be understood that the drive module 16 does not require two drive units 36, but may include any desired number of one or more drive unit 36.

In this example, the normal force generator 38 is controlled by a normal force controller 40, which repeatedly determines slip of the corresponding drive units 36, such as described above. Whenever the slip is excessive, the controller 40 causes the normal force generator 38 to increase the normal force on the drive unit(s) 36 until the slip is deemed not excessive by the controller 40. Also, if desired, when the slip falls below a minimum acceptable level, the normal force controller 40 can be designed to cause the normal force generator 38 to decrease the normal force on the drive unit(s) 36 until the slip is determined by the controller 40 to be acceptable. This process continues so long as efficient tractor movement in the borehole is desired. The normal force controller 40 of this embodiment thus controls the dynamic application of normal force to the drive unit(s) 36 by the normal force generator 38.

One or more force transducer 42 is also included in this example to provide information about the traction force of each drive unit 36. This information may be used for any desired purpose, such as to assist in sharing the load among multiple drive units. However, transducers and load sharing among multiple drive units are not required.

Still referring to the "black box" representation of FIG. 9, various potential data flow paths between components of this embodiment are generally indicated with arrows 29. For example, the normal force controller 40 is shown receiving the drive unit velocity ($V_1$) from the drive units 36 and the tractor velocity ($V_2$) from the main controller 14 for its determination of actual drive unit slip ($S_A$). The normal force controller 40 is shown providing the normal force generator 38 with commands for the application or removal of normal force to the drive units 36.

For some optional examples, the drive units 36 provide drive unit torque to the main controller 14 for determining load sharing, providing information about bore hole conditions or any other suitable purpose. The drive units 36 may be equipped with internal speed control mechanisms and may receive requested speed settings through the main controller 14 from an operator or other source. In another optional example, the main controller 14 is shown providing borehole diameter data to the normal force controller 40 for determining the magnitude of normal force to be applied to the drive units 36. For example, the normal force may be reduced in anticipation of an upcoming well restriction. However, other or different data may be exchanged between various components. The above examples of data flow are neither required by, nor limiting upon, the present invention.

Figure 10:
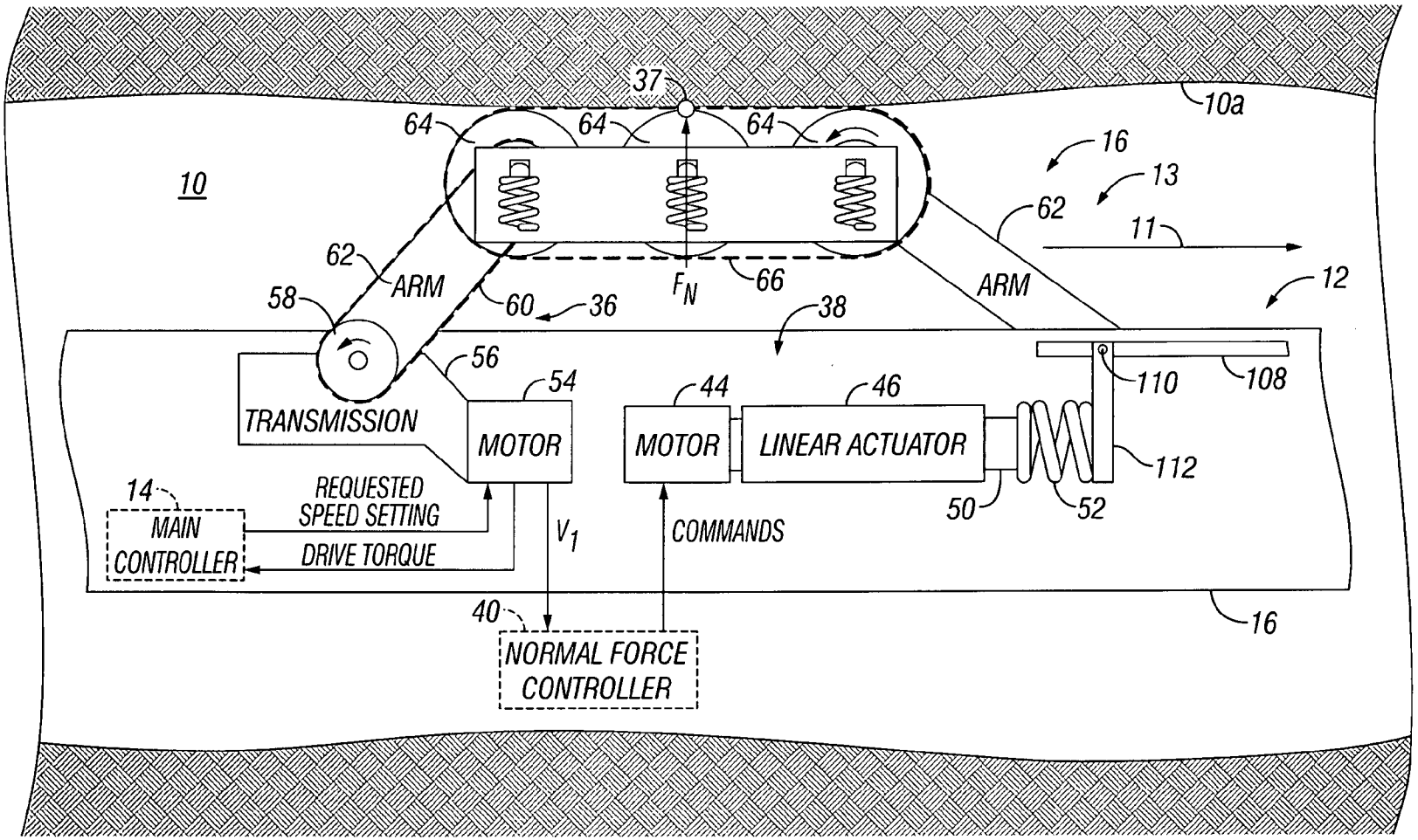
FIG. 10 is a partial block diagram of an embodiment of a drive module in accordance with the present invention deployed in a borehole.
Figure 11:
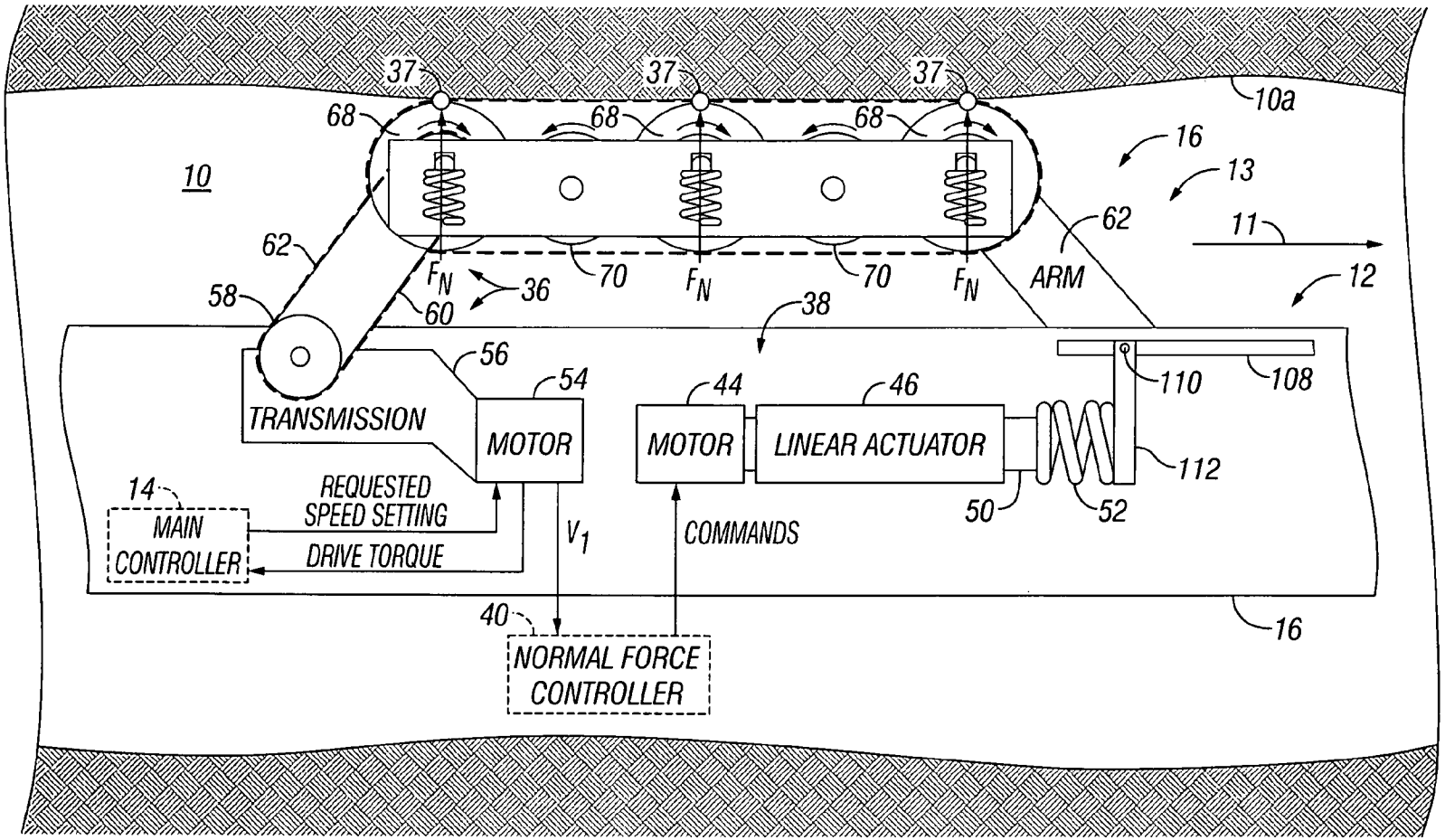
FIG. 11 is a partial block diagram of another embodiment of a drive module in accordance with the present invention deployed in a borehole.
Figure 12:
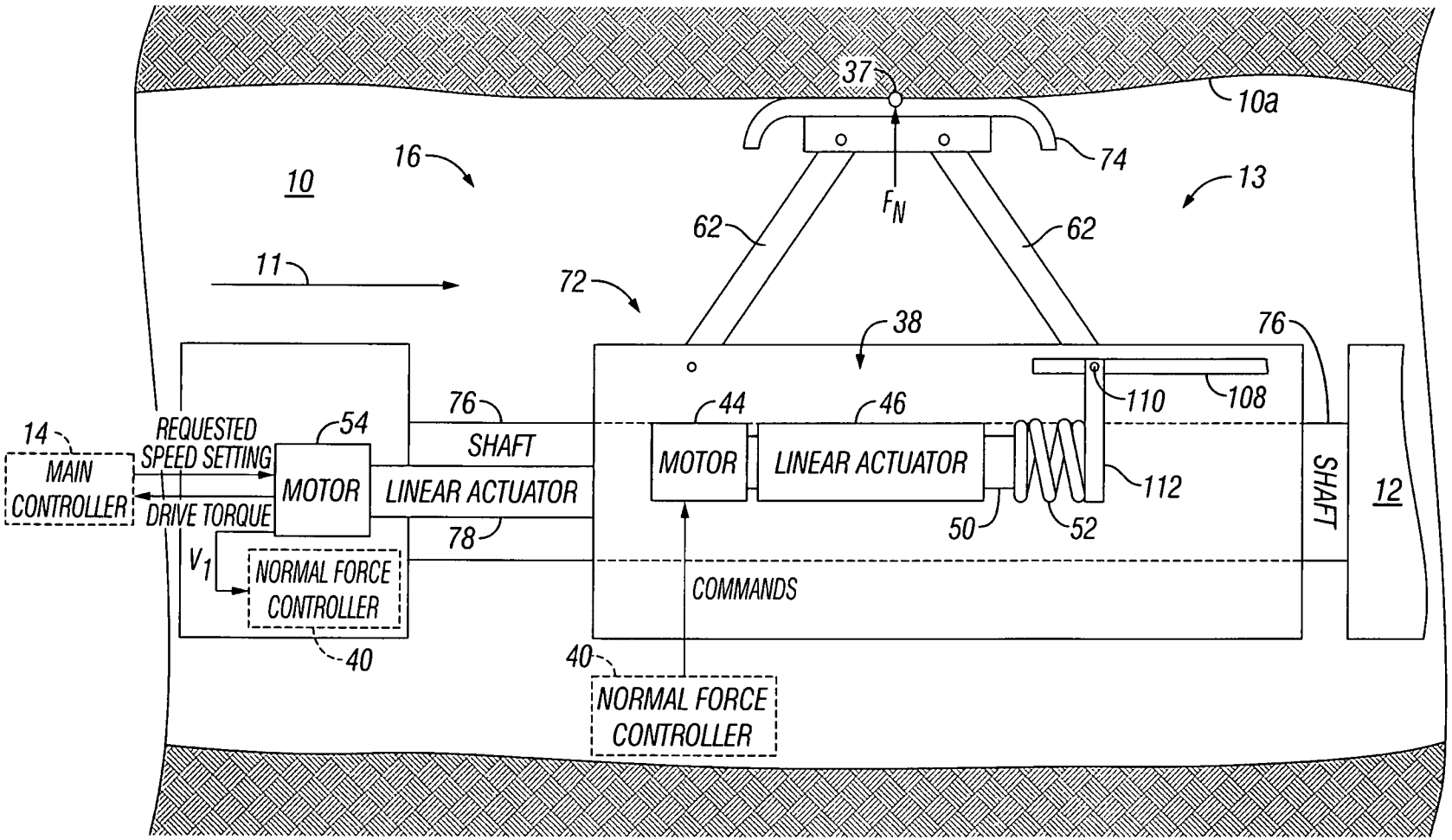
FIG. 12 is a partial block diagram of yet another embodiment of a drive module in accordance with the present invention deployed in a borehole.

FIGS. 10–12 illustrate various particular embodiments of the drive module 16 in partial block diagram format disposed in a borehole 10. In the example of FIG. 10, the drive unit 36 includes a drive motor 54, a transmission 56 and multiple sprocket wheels 64. The transmission 56 has a transmission wheel 58, transmission chain 60 and arm 62, which drive the sprocket wheels 64. The sprocket wheels 64 move a drive chain 66, which contacts the borehole wall 10*a*, transmits drive torque from the drive motor 54 to the wall 10*a* and displaces the tractor 12.

Still referring to FIG. 10, the normal force generator 38 of this embodiment includes a normal force motor 44 and a linear actuator 46. The linear actuator 46 may be mechanical, electromagnetic, hydraulic or any other suitable type. If desired, the linear actuator may be equipped with a suspension element 52 and a load measuring device 50, such as a load cell. An arm 62 extends between the end 112 of the linear actuator 46 and the sprocket wheel(s) 64.

The linear actuator 46 converts rotary motion of the normal force motor 54 to linear motion. The linear force generated by the linear actuator 46 is converted into the normal force that presses the drive chain 66 against the borehole wall 10*a*. This force conversion takes place at a pin, or joint, 110 disposed at the front end 112 of the linear actuator 46 and which is slidable within a slot 108 in the drive module 16. Thus, increasing the linear force generated by the normal force generator 38 moves the joint 110 forward in the slot 108, decreasing the normal force applied to the sprocket wheels 64. Likewise, the normal force will be increased when linear force applied to the joint 110 is decreased.

Now referring to the embodiment of FIG. 11, the drive unit 36 is generally the same as the drive unit 36 of the embodiment of FIG. 10, except with respect to that portion that engages the borehole wall 10*a*. In this example, at least one drive wheel 68 is driven by the transmission chain 60 and arm 62 and engages the borehole wall 10*a* to displace the tractor 12. When multiple drive wheels 68 are included, drive torque may be transmitted to the drive wheels 68 by gears 70 located between the drive wheels 68. The normal force generator 38 of this example operates similarly as that shown and described with respect to FIG. 10, but, in this instance, with respect to the drive wheels 68.

In the embodiment of FIG. 12, the drive module 16 includes a grip assembly 72 that is movable forward and rearward on a shaft 76 driven by a drive motor 54 and a linear actuator 78 located within the shaft 76. The shaft 76 reciprocates between a power stroke and a return stroke. The grip assembly 72 includes at least one gripping pad 74 that engages and slides along the borehole wall 10*a*. The use of grip-type technology for moving downhole tractors is disclosed in U.S. Pat. No. 6,179,055 issued on Jan. 30, 2001 to Sallwasser et al., which is hereby incorporated by reference herein in its entirety.

The normal force generator 38 of this embodiment is generally the same as that described above with respect to FIG. 10. However, instead of exerting a continuous normal force on sprocket wheels, the normal force applied to the gripping pad 74 of this embodiment alternates. During the power stroke of the shaft 76, the grip embodiment 72 and gripping pad 74 are stationary relative to the borehole 10. Consequently, the normal force applied to the gripping pad 74 by the normal force generator 38 must be sufficient enough to overcome loss of traction. During the return stroke of the shaft 76, no normal force may be desired, such as to reduce resistance and avoid component wear.

Figure 13:
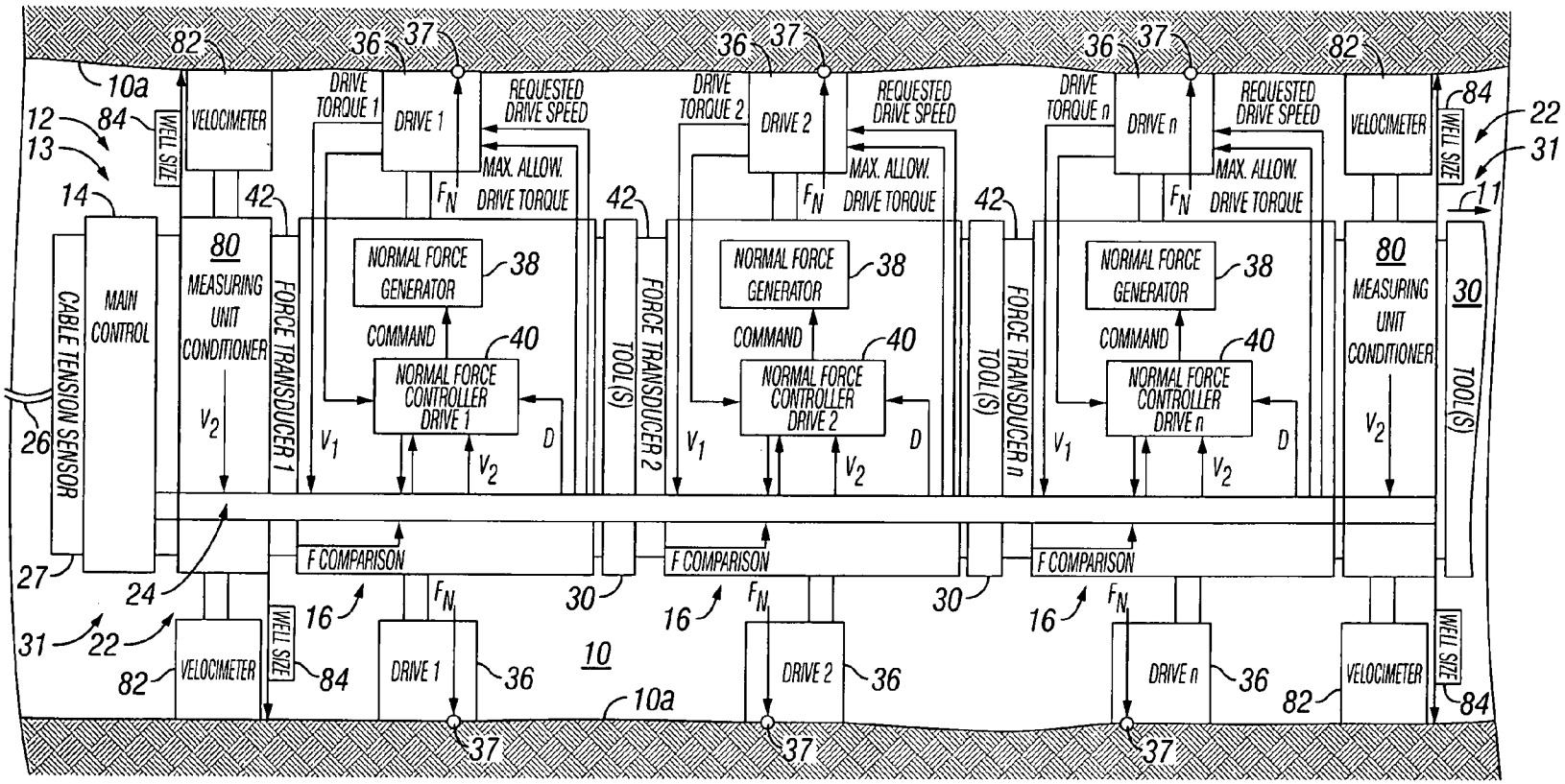
FIG. 13 is partial block diagram of a bi-directional downhole tractor equipped with an embodiment of a traction control system having at least three drive modules in accordance with the present invention.

Now referring to FIG. 13, an embodiment of a bi-directional downhole tractor 12 equipped with an exemplary traction control system 13 of the present invention is shown in partial block diagram format deployed in a borehole 10. The tractor 12 includes at least three drive modules 16 (drive $module_1$, drive $module_2$, drive $module_n$), each similar to the drive module 16 described above with respect to FIG. 9. A measuring unit 22, similar to that described above with respect to FIG. 5, is included at each end of the tractor 12. The main controller 14 communicates with the various tension control system components via the data bus 24. A cable 26 and cable tension sensor 27 allow communication between the main controller 14 and the surface (not shown). The main controller 14, normal force controller 40 and measuring unit conditioner 80 may be electronic, mechanical, hydraulic or driven by any other suitable technology or technique, or a combination thereof.

Still referring to the embodiment of FIG. 13, multiple (optional) force transducers 42 are included for measuring and comparing the traction force of the various drive units 36. The force comparison data ($F_{comparison}$) is communicated to the main controller 14 for any desired use, such as to share load among the drive units to improve efficiency. Also, multiple conveyed devices, or tools, 30 are shown disposed between the drive modules 16 and at the forward end of the tractor 12 in the illustrated tool string 31.

Figure 14:
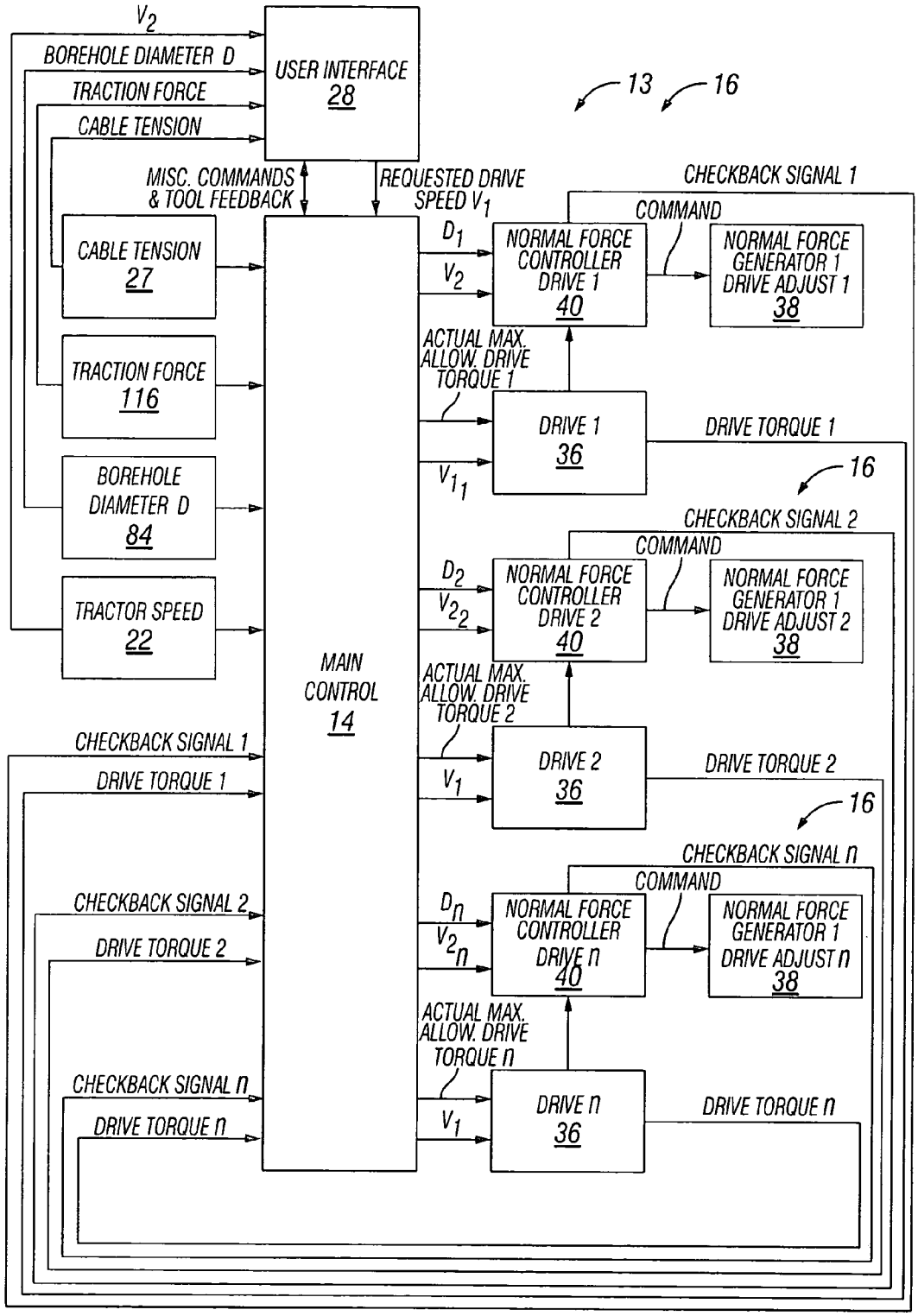
FIG. 14 is a flow diagram illustrating inputs and outputs of various components of an embodiment of a traction control system in accordance with the present invention.

The flow diagram of FIG. 14 shows example input and outputs of various components of an embodiment of a downhole tractor traction control system 13 for use in a borehole (not shown) in accordance with the present invention. Each (one or more) drive module 16 includes a drive unit 36, normal force generator 38 and normal force controller 40. Various measuring instruments, such as a cable tension measurement device 27, traction force measurement device 116, well size detector 84 and tractor speed measuring unit 22, provide information, such as cable tension, traction force, borehole diameter ($D_1$) and tractor speed ($V_2$), respectively, on an ongoing or repeating basis to the main controller 14 and the user interface 28.

The main controller 14 communicates with the operator, or surface, at a user interface 28. Various information may be exchanged between the main controller 14 and user interface 28. For example, commands, such as a requested drive unit velocity ($V_1$), may be provided from the user interface 28 to the main controller 14. The main controller 14 of this embodiment may honor or suppress such commands based upon one or more condition or circumstance. If a requested drive unit velocity ($V_1$) is honored by the main controller 14, the controller 14 will pass the command on to the individual drive units 36. If desired, this request may be made only at the start of operations or at certain times during operations. The main controller 14 may provide additional information, such as maximum allowable torque, to each drive unit 36.

The main controller 14 notifies each normal force controller 40 of the tractor velocity ($V_2$) and pertinent borehole diameter ($D_1$). Each normal force controller 40 gives the commands to its corresponding normal force generator 38 to apply the desired normal force to the respective drive unit 36. The normal force controllers 40 also provide a checkback signal to the main controller 14. The checkback signal may be used by the main controller 14 for logging information, such as the actual friction factor. Also, in this example, each drive unit 36 notifies the main controller 14 of its actual torque. It should be understood, however, that each of the above exemplary inputs, outputs and data communications is not required.

Figure 15:
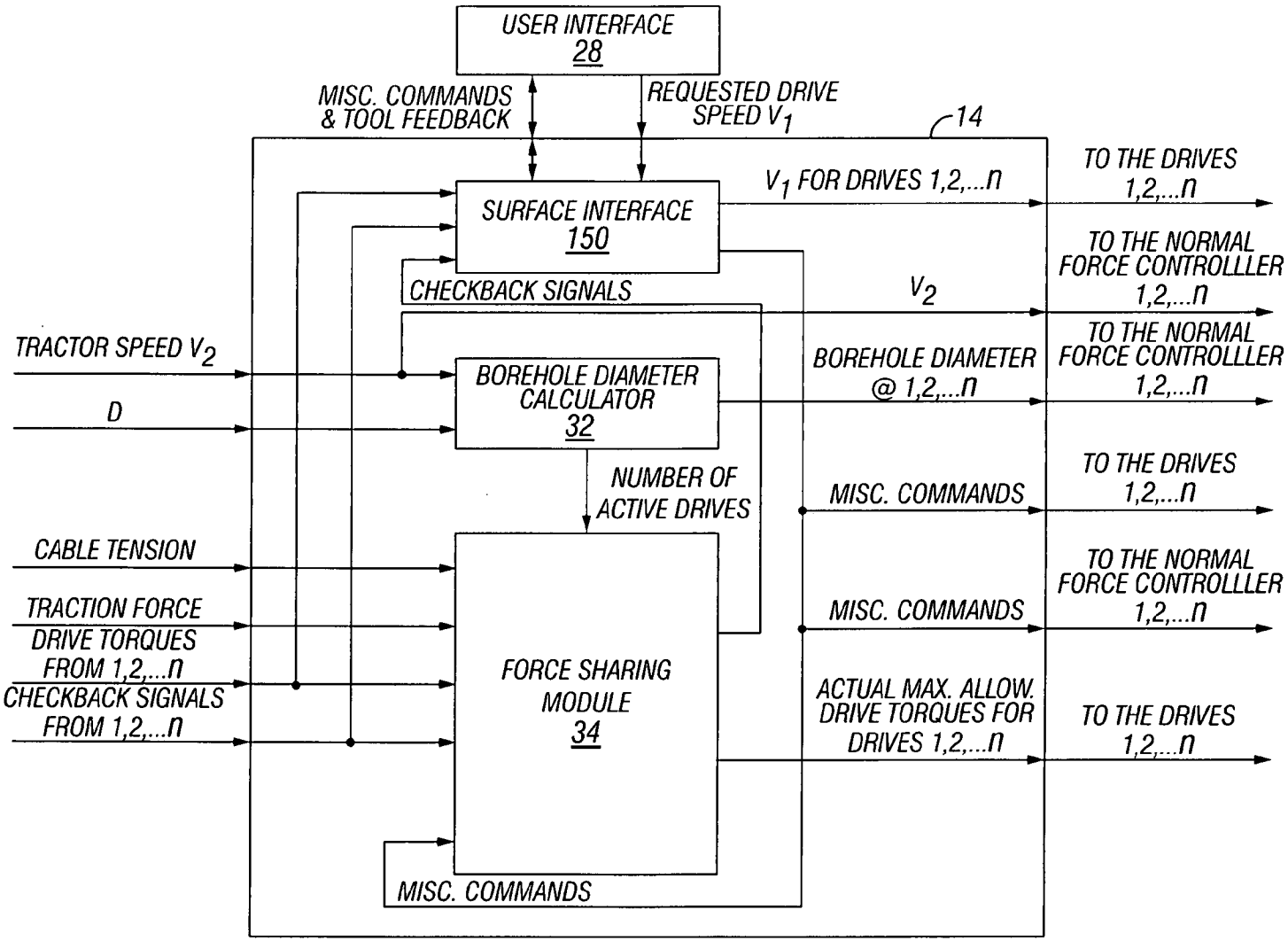
FIG. 15 is a flow diagram illustrating inputs and outputs of the inner modular structure of an embodiment of a main controller in accordance with the present invention.

Additional components, capabilities and/or features may be included in the traction control system of the present invention to provide additional functions. For example, referring to FIG. 15, an embodiment of the main controller 14 is shown including a surface interface 150, well size calculator 32 and force sharing module 34. The surface interface 150 communicates with the user interface 28. The well size calculator 32 calculates borehole diameter based upon measurements from a borehole size detector (not shown). The force sharing module 34 balances the load distribution among multiple drive units 36. This feature may desirable, for example, to improve the ability of the tractor to overcome various obstacles, such as washouts, borehole restrictions and obstructions. The exemplary force sharing module 34 requires checkback signals representing force values measured by transducers (not shown) and cable tension values.

Preferred embodiments of the present invention thus offer advantages over the prior art and are well adapted to carry out one or more of the objects of the invention. However, the present invention does not require each of the components and acts described above, and is in no way limited to the above-described embodiments and methods of operation. Further, the methods described above and any other methods which may fall within the scope of any of the appended claims can be performed in any desired suitable order and are not necessarily limited to the sequence described herein or as may be listed in any of the appended claims. Yet further, the methods of the present invention do not require use of the particular embodiments shown and described in the present specification, but are equally applicable with any other suitable structure, form and configuration of components.

The present invention does not require all of the above components, features and processes. Any one or more of the above components, features and processes may be employed in any suitable configuration without inclusion of other such components, features and processes. Further, while preferred embodiments of this invention have been shown and described, many variations, modifications and/or changes of the system, apparatus and methods of the present invention, such as in the components, details of construction and operation, arrangement of parts and/or methods of use, are possible, contemplated by the patentee, within the scope of the appended claims, and may be made and used by one of ordinary skill in the art without departing from the spirit or teachings of the invention and scope of appended claims. Moreover, the present invention includes additional features, capabilities, functions, methods, uses and applications that have not been specifically addressed herein but are, or will become, apparent from the description herein, the appended drawings and claims. Thus, all matter herein set forth or shown in the accompanying drawings should thus be interpreted as illustrative and not limiting. Accordingly, the scope of the invention and the appended claims is not limited to the embodiments described and shown herein.

The invention claimed is:

1. A method of controlling the traction of a downhole tractor in a borehole, the traction created by applying normal force to at least one drive unit associated with the tractor, the at least one drive unit being engageable with and moveable relative to the borehole wall, the method comprising:

repeatedly determining the slip of the at least one drive unit;

repeatedly determining if the slip of the at least one drive unit is excessive; and if the slip of the at least one drive unit is excessive, increasing the normal force on the at least one drive unit.

2. The method of claim 1 wherein movement of the tractor may be maintained during typical downhole operating conditions despite the presence of one or more disturbance factor.

3. The method of claim 1 wherein the acts of repeatedly determining the slip of the at least one drive unit, repeatedly determining if the slip of the at least one drive unit is excessive and increasing the normal force on the at least one drive unit if the slip of the at least one drive unit is excessive are performed on a real-time basis without human intervention.

4. The method of claim 3 further including determining if the slip of the at least one drive unit is below a minimum acceptable slip and decreasing the normal force on the at least one drive unit if the slip of the at least one drive unit is below the minimum acceptable slip.

5. The method of claim 4 wherein the acts of repeatedly determining the slip of the at least one drive unit, repeatedly determining if the slip of the at least one drive unit is excessive, increasing the normal force on the at least one drive unit if the slip of the at least one drive unit is excessive, determining if the slip of the at least one drive unit is below a minimum acceptable slip and decreasing the normal force on the at least one drive unit if the slip of the at least one drive unit is below the minimum acceptable slip are repeated sufficiently frequently to generally optimize energy usage in moving the tractor within the borehole at an acceptable speed.

6. The method of claim 4 wherein the acts of repeatedly determining the slip of the at least one drive unit, repeatedly determining if the slip of the at least one drive unit is excessive, increasing the normal force on the at least one drive unit if the slip of the at least one drive unit is excessive, determining if the slip of the at least one drive unit is below a minimum acceptable slip and decreasing the normal force on the at least one drive unit if the slip of the at least one drive unit is below the minimum acceptable slip are repeated sufficiently frequently to maintain an at least substantially constant tractor velocity.

7. A method of controlling the traction of a downhole tractor in a borehole, the traction created by applying normal force to at least one drive unit associated with the tractor, the at least one drive unit being engageable with and moveable relative to the borehole wall, the method comprising:

repeatedly determining the slip of the at least one drive unit;

repeatedly determining if the slip of the at least one drive unit is within an acceptable slip range, the acceptable slip range having an acceptable minimum slip and an acceptable maximum slip; and if the slip of the at least one drive unit is below the acceptable minimal slip, decreasing the normal force on the at least one drive unit.

8. The method of claim 7 wherein the traction force of the downhole tractor is controlled on a real-time basis without human involvement.

9. The method of claim 8 further including increasing the normal force on the at least one drive unit if the slip of the at least one drive unit is above the acceptable maximum slip.

10. A method of adjusting the traction of a downhole tractor in a borehole, the traction created by applying normal force to at least one drive unit associated with the tractor, the at least one drive unit being engageable with and moveable relative to the borehole wall, the method comprising:

measuring the velocity of the at least one drive unit;

measuring the velocity of the tractor;

determining the slip of the at least one drive unit based upon the velocity of the at least one drive unit and the velocity of the tractor;

comparing the slip of the at least one drive unit to an acceptable slip value to determine if the slip of the at least one drive unit is excessive; and if the slip of the at least one drive unit is excessive, increasing the normal force on the at least one drive unit.

11. The method of claim 10 further including continuously, frequently repeating the steps of claim 10 as long as movement of the tractor in the borehole is desired.

12. The method of claim 11 further including determining if the slip of the at least one drive unit is below a minimum acceptable slip and decreasing the normal force on the at least one drive unit if the slip of the at least one drive unit is below the minimum acceptable slip.

13. The method of claim 12 further including continuously, frequently repeating the steps of claim 12 without human intervention as long as movement of the tractor in the borehole is desired.

14. A method of real-time, dynamic adjustment of the traction of a downhole tractor in a borehole without human intervention, the traction created by applying normal force to at least one drive unit associated with the tractor, the at least one drive unit being engageable with and moveable relative to the borehole wall, the method comprising:

increasing the normal force on the at least one drive unit when the slip of the at least one drive unit relative to the borehole wall is excessive; and decreasing the normal force on the at least one drive unit when the slip of the at least one drive unit relative to the borehole wall is below a minimum acceptable slip value.

15. The method of claim 14 further including repeatedly measuring the velocity of the at least one drive unit and the velocity of the tractor, determining the slip of the at least one drive unit based upon the velocities of the at least one drive unit and the tractor and comparing the slip of the at least one drive unit to an acceptable slip value to determine whether the slip of the at least one drive unit is excessive.

16. A method of real-time, dynamic adjustment of the traction of a downhole tractor in a borehole without human intervention, the traction created by applying normal force to at least one drive unit associated with the tractor, the at least one drive unit being engageable with and moveable relative to the borehole wall, the method comprising:

changing the normal force applied to at least one drive unit in response to a suitable change in at least one among the diameter of the borehole, the presence of debris in the borehole, one or more borehole fluid property, the surface of the borehole, the inclination of the borehole, one or more borehole wall property, the actual slip of the at least one drive unit relative to the borehole wall, the coefficient of friction between the at least one drive unit and the borehole wall, and the drag created by a cable connected with the tractor.

17. A method of optimizing the amount of energy required for maintaining the movement of a downhole tractor within a borehole without human intervention, the tractor including at least one drive unit engageable with and moveable relative to a wall of the borehole upon the application of normal force to the at least one drive unit, the method including:

automatically, dynamically adjusting the normal force applied to the at least one drive unit in response to changes in the actual slip of the at least one drive unit relative to the borehole wall as compared to an acceptable slip value.

18. A method of optimizing the amount of energy required for maintaining the movement of a downhole tractor within a borehole, the tractor including at least one drive unit engageable with and moveable relative to a wall of the borehole upon the application of normal force to the at least one drive unit, the method including:

automatically changing the normal force applied to at least one drive unit without human intervention in response to one or more change in at least one among the diameter of the borehole, the presence of debris in the borehole, one or more borehole fluid property, the surface of the borehole, the inclination of the borehole, one or more borehole wall property, the actual slip of the at least one drive unit relative to the borehole wall, the coefficient of friction between the at least one drive unit and the borehole wall, and the drag created by a cable connected with the tractor.

* * * * *